US005992694A

United States Patent [19]

Keller

[11] Patent Number: 5,992,694

[45] Date of Patent: Nov. 30, 1999

[54] MANUALLY OPERATED DISPENSING DEVICE FOR A DOUBLE DISPENSING CARTRIDGE

[76] Inventor: Wilhelm A. Keller, Obstgartenweg 9, CH-6402 Merlischachen, Switzerland

[21] Appl. No.: 08/803,856

[22] Filed: Feb. 21, 1997

[30] Foreign Application Priority Data

Feb. 21, 1996 [EP] European Pat. Off. ..... 96810101
Nov. 12, 1996 [EP] European Pat. Off. ..... 96810778

[51] Int. Cl.[6] ..... B05C 17/01

[52] U.S. Cl. ..... 222/137; 222/391

[58] Field of Search ..... 222/137, 145, 222/327, 391; 74/112, 116, 141.5, 148, 169

[56] References Cited

U.S. PATENT DOCUMENTS

| | | | |
|---|---|---|---|
| 958,994 | 5/1910 | Davis | 222/391 |
| 2,138,045 | 11/1938 | Seeberger | 74/148 |
| 2,229,839 | 1/1941 | Crewe | 222/391 |
| 4,452,285 | 6/1984 | Leibhard et al. | 222/391 |
| 5,137,181 | 8/1992 | Keller | 222/137 |
| 5,248,068 | 9/1993 | Goergen et al. | 222/391 |
| 5,314,092 | 5/1994 | Jacobsen et al. | 222/137 |
| 5,400,925 | 3/1995 | Simmen | 222/137 |

FOREIGN PATENT DOCUMENTS

| | | | |
|---|---|---|---|
| 0 408 494 | 1/1991 | European Pat. Off. . | |
| 0 615 787 | 2/1991 | European Pat. Off. . | |
| 0 543 776 | 5/1993 | European Pat. Off. . | |
| 905049 | 9/1962 | United Kingdom | 222/391 |
| 2153009 | 8/1985 | United Kingdom . | |

*Primary Examiner*—J. Casimer Jacyna
*Attorney, Agent, or Firm*—Foley & Lardner

[57] ABSTRACT

The manually operated dispensing device for a double dispensing cartridge comprises a double thrust ram having a toothing and a drive means which is actuated by a trigger lever and which jointly acts on the double thrust ram, this drive means having a drive member which acts via a toothing on the toothing of the double thrust ram, an arc compensating element being arranged between the drive member and the trigger lever. The drive member is guided in such a manner that it is able to make a linear motion during its advance stroke but no swivelling or tilting motion but can make a swivelling motion for disengaging the double thrust ram or for the return stroke movement of the drive member, the arc compensating element for the trigger lever being a compensating link, pivotably connected at its one end to the trigger lever above its fulcrum by a first fulcrum pin and at its other end to the drive member by a second fulcrum pin. Due to the absence of relative motions between the teeth during the advance motion as well as achieving favorable force impact points, thus avoiding undue jamming and tilting moments, resulting in decreased frictional losses, the device has a high mechanical efficiency and optimizes the dispensing volume per stroke in one of its versions.

16 Claims, 8 Drawing Sheets

MANUALLY OPERATED DISPENSING DEVICE FOR A DOUBLE DISPENSING CARTRIDGE

BACKGROUND OF THE INVENTION

The present invention refers to a manually operated dispensing device for use with a double cartridge for dispensing two-component chemical systems, the device comprising a double thrust ram comprising a toothing and a drive means jointly acting on the double thrust ram and being actuated by a trigger lever, said drive means having a drive member which comprises a toothing acting on the toothing of the double thrust ram, an arc compensating element being arranged between the drive member and the trigger lever, wherein the drive member is guided in such a manner.

Such a dispensing device is already known from EP-A-0,615,787 to the same Applicant. This device had certain advantages over the prior art known at that time in that it could be manufactured with lower cost parts from plastic materials due to the simultaneous meshing of a plurality of teeth. However, it has now been found that this device is still able to be substantially improved, and that in particular jamming, which is caused in the guide members by having a linear engagement movement, is a problem during the use under high dispensing forces. In addition, high jamming or tilting moments are created in that the driving dog must be guided with respect to the housing by an additional slider whose connecting link is disposed, particularly when the supply cylinders of the cartridges have the same or only slightly different diameters, in a disadvantageous manner below the center line of the reactive force, and that the lateral force impact point of cartridges having different diameters, especially widely different cylinder diameters, is not appropriately located. This results in all cases in a substantial loss of mechanical efficiency.

Another dispensing device has become known from U.S. Pat. No. 5,314,092, wherein the thrust rams acting on supply cylinders having different diameters are not symmetrically disposed but are offset to the side having the higher reactive forces; however, the driving arrangement is totally different from that of the present invention and does not provide a compensating link.

SUMMARY OF THE INVENTION

Starting from this prior art, it is an object of the present invention to provide a dispensing device which overcomes the disadvantages mentioned above when cartridges of the same as well as of widely different diameters are used, has a higher efficiency and a drive means less sensitive to becoming inoperable by contamination.

These objects are attained by a manually operated dispensing device wherein the drive member is guided in such a manner that it is hindered from making any tilting motion or any motion transversely to the advance direction during its advance stroke but can effect a swivelling motion for allowing its disengagement from the double thrust ram for its return stroke or for unlocking the double thrust ram for grip regain, the arc compensating element for the trigger lever being a compensating link connected for rotation at one of its ends through a first fulcrum upper pin to the trigger lever and at its other end through a second fulcrum pin to the drive member.

Special or preferred embodiments of the invention are defined in the dependent claims, especially also for cartridges having a diameter ratio of from 4:1 to 10:1.

A further object of the present invention is to provide a manually operated dispensing device having a return stop device that is better suited for maximizing the dispensed amount per stroke than the device of EP-A-0,615,787. This object is attained by the device wherein the dispensing device comprises a return stop device having a locking slider acting on the toothing of the double thrust ram.

BRIEF DESCRIPTION OF THE DRAWING

The invention will be described as follows by means of embodiments thereof with reference to the accompanying drawing, wherein.

DETAILED DESCRIPTION OF THE INVENTION

Figure 1:
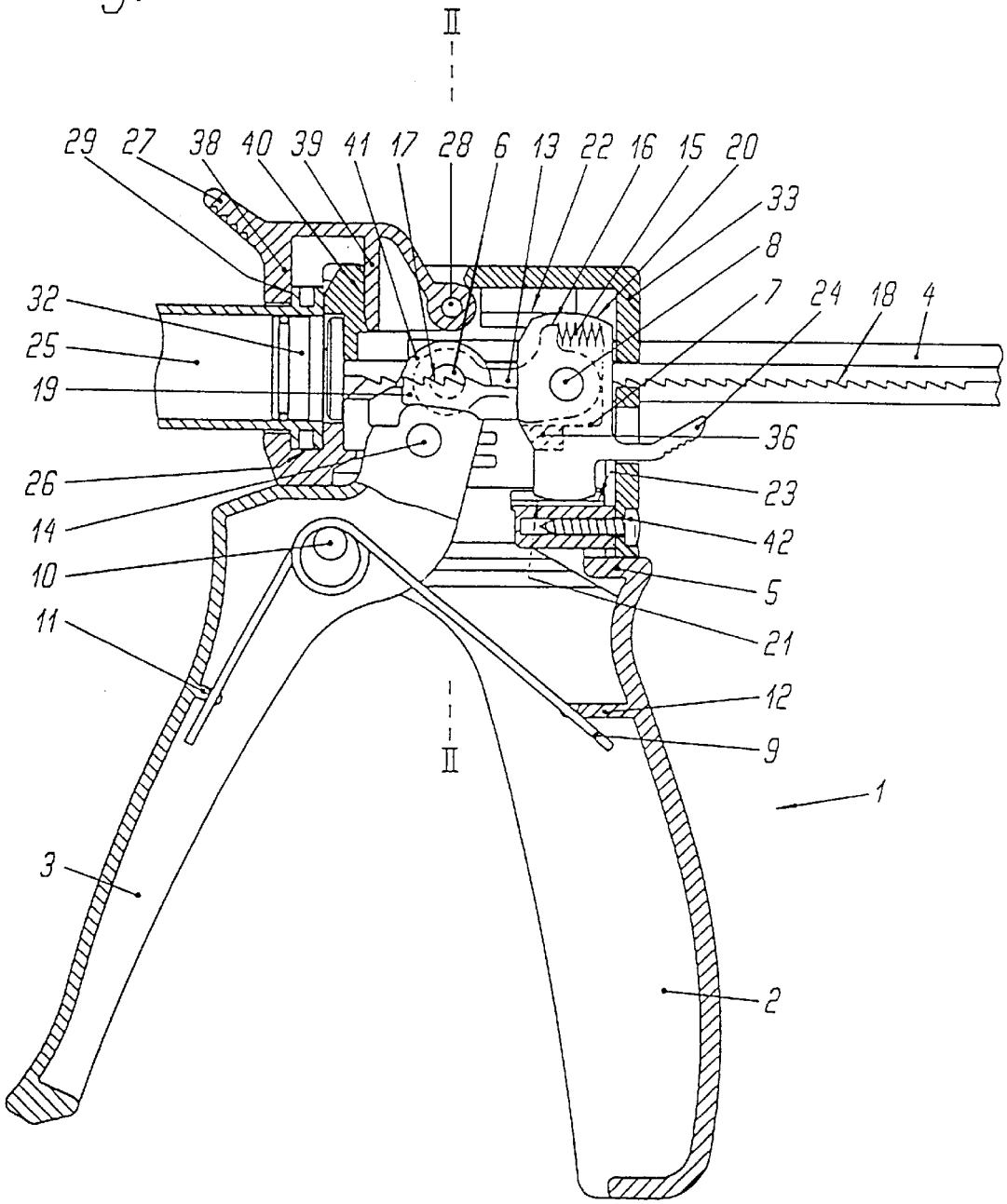
FIG. 1 shows a longitudinal section of a dispensing device according to the invention.

According to a definition used in the description and drawing, the side comprising the handle 2 is "below", and the opposite side comprising the retaining flap 27, is considered as "above", see FIG. 1.

The device 1 comprises a handle 2 having a trigger lever 3 which acts via actuating parts on a double thrust ram 4 which, in turn, acts on the dispensing pistons 32 of a double cartridge 25 in order to deliver the two chemical components from the cartridge. The handle 2 is integral with the housing 5, this housing 5 containing different guides, ribs etc., as well as a cover 33; these parts will be described in more detail in the following description.

The trigger lever 3 is connected via an upper pin 6, which is the point of drive force impact of the trigger lever, to one end of a compensating link 13 which serves as an arc compensation and whose other end is connected by a pin 8 to a drive member 7, this pin 8 also acting as a fulcrum for pivoting the drive member 7. The trigger lever 3 pivots about an axle 14 which is journalled in the housing slightly below the upper pin 6. A compression spring 15 rests against a nose 16 of the compensating link 13 while pushing against the drive member 7.

As it can be seen from FIG. 1, the upper pin 6, which receives the point of drive impact force of the trigger lever 3 and the pin 8 as the fulcrum of the drive member 7, are located between the two parts of the toothed double thrust ram 4, on the same level of the toothing 18 of the double thrust ram 4. This arrangement avoids vertical jamming and tilting moments. Ideally, the toothing should be situated within, or as close as possible to, the plane of the longitudinal axes of the cartridge containers.

Figure 2:
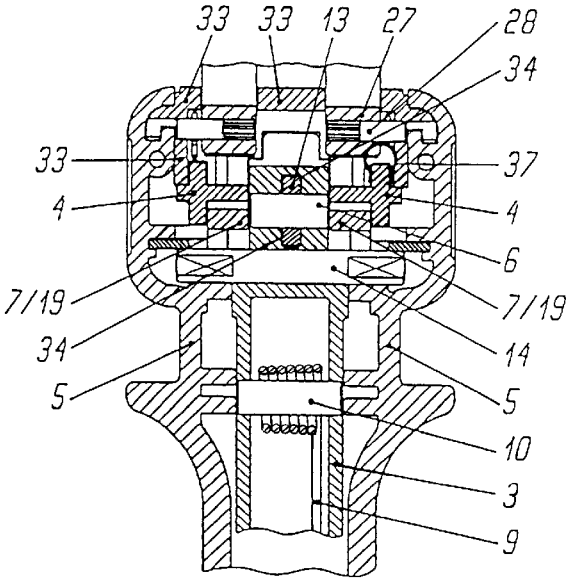
FIG. 2 shows a section of the dispensing device of FIG. 1 according to line II—II.

Furthermore, the trigger lever 3 is tensioned by a spring 9 which is movably attached to a pin 10 and abuts against a rib 11 of the trigger lever and a rib 12 of the handle. The drive member 7 comprises, seen in the direction of discharge, an upper toothing 17 which meshes with the toothing 18 of the double thrust ram. As is shown in FIG. 2, the compensating link 13 is laterally guided in a slot 34 of the trigger lever 3 at one end and in a slot of the drive member 7 at the other end, as indicated in dashed lines in FIG. 1, so that jamming of the compensating link is prevented.

Figure 4:
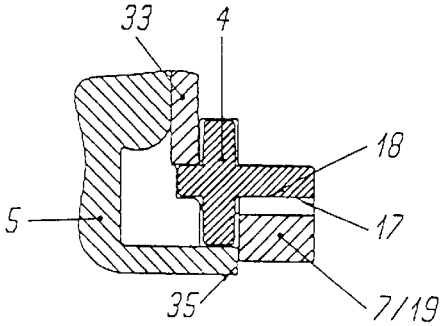
FIG. 4 shows a detail of FIG. 2 in an enlarged scale.
Figure 3:
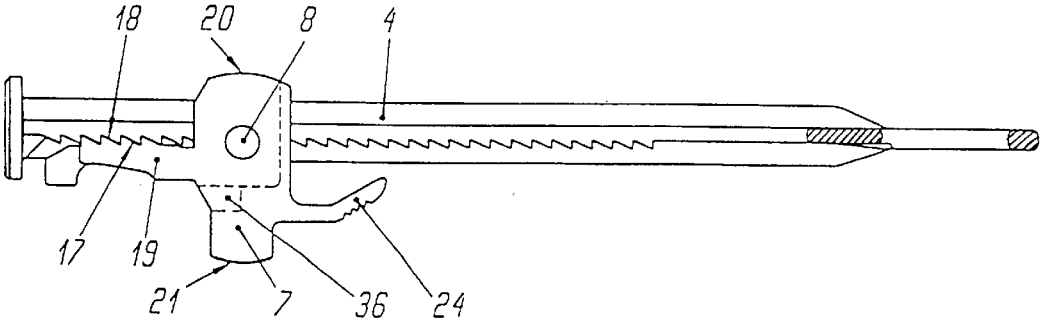
FIG. 3 shows a detail of the drive member.

The drive member 7, which has a slide and latch like configuration and comprises two arms 19 provided with toothings 17 on their upper sides, is laterally guided by side guides 35 of the housing, see FIG. 4, thus preventing its tilting or jamming. As can be seen in FIG. 1, the drive member 7 is additionally guided in grooves 22 and 23 of the housing, the upper side 20 and the lower side 21 of the drive member 7 being rounded as part of an arc of a circle so that it is still able to make a slight swivelling movement but cannot deviate upward, downward or laterally. The drive member thus makes a linear advancing and retracting movement. The drive member 7 further comprises an integral lever 24 for disengaging its toothing 17 from the toothing 18 of the double thrust ram 4 for its retraction.

It is evident from the description and the Figures that, when the trigger lever 3 is actuated, it will pivot about the pin 14, journalled in the housing, and will entrain the compensating link 13 by means of the upper pin 6 in the forward direction, namely in the dispensing direction. The compensating link 13 pulls the drive member 7, whose toothing 17 are engaged with the toothing 18 of the double thrust ram 4, through the pin 8 to the left in FIG. 1 and entrains the double thrust ram 4 in the dispensing direction. During the advance stroke, the toothing of the drive member 7 meshes without any movement relative to the toothing of the double thrust ram. The compression spring 15 which rests against the nose 16 of the compensating link 13 and which is located above the pin 8, ensures that the meshing of the toothing of the drive member 7 and of the double thrust ram 4 is also maintained after the return stroke movement of the drive member 7. Furthermore, a stop 36 on the drive member 7 limits the swivelling angle of the drive member 7. The lever 24 allows a swivelling disengagement of the drive member and thus a retraction of the double thrust ram 4.

By the use of a compensating link which is fastened by, yet pivotable about, the two pins 6 and 8 in the plane of toothing 17 and 18, and by the use of a linearly guided drive member 7 which may allow small swivelling motions during the return stroke or for the retraction of the thrust ram 4, a state whereby no relative motion between the teeth of the drive member 7 and the teeth of the thrust ram 4 is achieved thus offering the possibility to have several teeth meshing simultaneously.

This is a crucial condition for an exact meshing of the teeth and a relatively low specific surface load on those teeth during the whole dispensing stroke, and since several teeth are in simultaneous meshing engagement, the shear forces per tooth are lower. However, on the other hand, the term "toothing" may mean one or more teeth.

Since the pins 6 and 8 as well as the toothings 17 and 18 are situated in about the same plane, it follows that the entire friction forces generated in the device are considerably lower than in those according to the prior art. The thus increased efficiency results in a lower load on the individual parts and requires considerably lower hand forces on the trigger lever.

In the first embodiment according to FIGS. 1 to 5, the device may comprise a thrust ram return brake in the form of a friction brake as it is disclosed in the above mentioned device according to EP-A-0,615,787. This friction brake may also be designed as an omega shaped spring 37 as shown in FIG. 2.

Figure 6A:
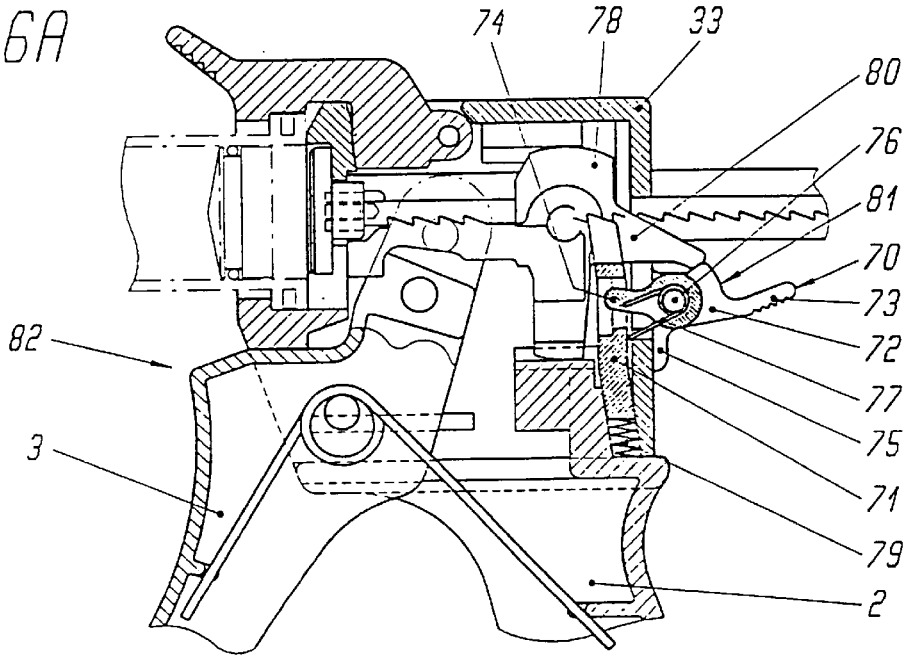
Figure 6B:
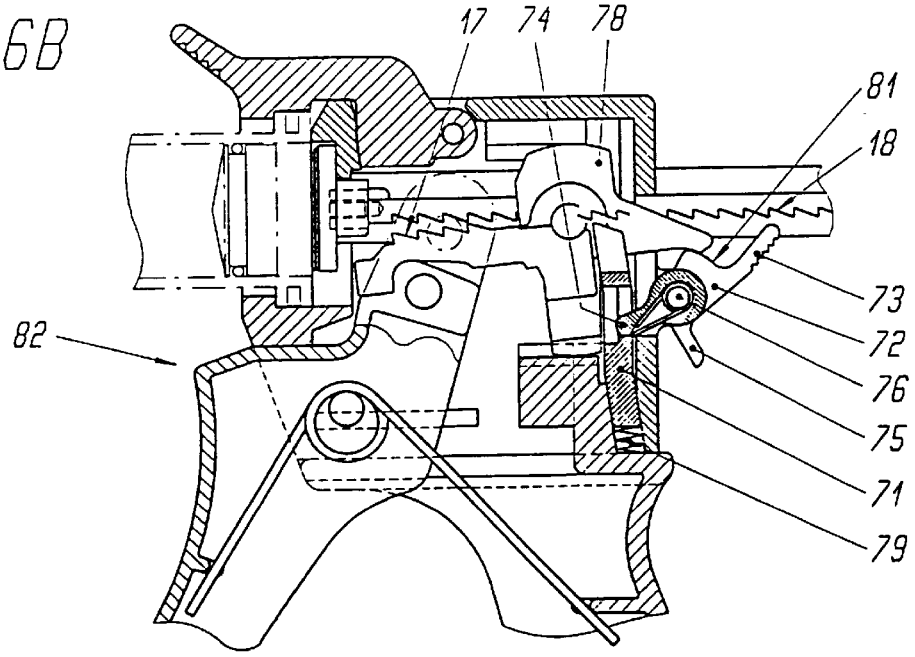

In order to prevent the double thrust ram from any return motion, or to allow a limited return motion only, it may be provided with a return stop device comprising a locking slider as shown in FIGS. 6A and 6B, FIG. 6A showing the locked position and FIG. 6B the unlocked one, instead of with the friction brake mentioned above, The automatically acting return stop device 70 of the dispensing device 82 comprises a locking slider 71 and an unlocking lever 72 acting thereon. The unlocking lever 72 consists of an actuating lever 73, a nose 74 and a stopper dog 75 and is pivotable around the axle 76. The nose 74 is charged by a leg spring 77 that pushes the unlocking lever 72 with its stopper dog 75 against the cover 33. A compression spring 79 pushes the locking slider 71 into a free tooth space of the toothing 18 of the double thrust ram 4 thus hindering the latter from going back by more than a limited distance or not at all.

For the return motion of the double thrust ram 4, it is required that the drive member 78 is disengaged and the locking slider 71 is unlocked, i.e. withdrawn from the engaging region of the toothing 18. This is accomplished in that the unlocking lever 72 is rotated by manually swivelling its lever actuating 73 about the axle 76. The actuating lever 73 of the unlocking lever 72 presses upon the projection 80 of the drive member 78 and disengages its toothing 17 from the toothing 18 of the double thrust ram 4. The drive member 78 is identical with the drive member 7, with the exception of the integral lever 24 which is replaced by the projection 80. Furthermore, the locking slider 71 is moved downward by the nose 74 of the unlocking lever 72 acting on the unlocking slider. A radial cam 81, being a part of the unlocking lever 72 and cooperating with the projection 80 of the drive member 78, ensures that first the drive member 78, and then only afterwards the locking slider 71 are disengaged. This arrangement achieves that reaction forces, emanating from the cartridge while still under pressure are transmitted via the double thrust ram 4 and are by the locking slider 71 instead of the drive member 78. Therefore, any jamming of the drive member is prevented, and the disengagement of the return stop device 70 is facilitated.

It depends upon the dispensing application whether a friction brake or a return stop device is used. By using a friction brake and upon relief of the trigger lever after disp üensing the double thrust ram will be allowed to retract by the distance required to essentially prevent the continued flow of the components. By using return stop devices, the double thrust ram is locked by means of the toothing, and the pressure on the pistons of the cartridge will be maintained to some extent thus allowing the maximizing of the dispensing stroke, i.e. the dispensed amount per stroke. Continued flow can be prevented by actuating the unlocking lever, thus releasing the locking slider as well as the double thrust ram thereby relieving the pressure in the cartridge.

When dispensing two component cartridges, wherein the two cartridge cylinders or containers have different cross-sectional areas, e.g. in the ratio of 2:1, different reaction forces occur against the double thrust ram which cause horizontal tilting and jamming moments. In order to avoid or to substantially reduce these moments, the point of impact of the advancing forces, i.e. the upper portion 41 of the trigger lever and the compensating link 13, respectively, may be shifted proportionately towards the side where the higher reaction forces are encountered, namely towards the cartridge having the greater cross-sectional area. It can also be that only portions of the trigger lever or the whole trigger lever including the handle, are arranged in an offset manner.

With cartridges where the cartridge cylinders have widely different cross-sectional areas, for example in a ratio of 10:1, the arrangement shown in FIGS. 1 and 2 is not the optimum since the desired lateral offset of the point of impact of the advancing forces causes an undesirable reduction of the toothing width on the thrust ram of the larger cartridge cylinder. The embodiments shown in FIGS. 7 to 11 take this condition into account in that the driving parts are disposed by the smallest possible distance below the toothing. This allows the offset required for high cartridge dispensing ratios, such as 10:1 for example, without reducing the width of the toothing.

By the lowering of the advance drive member, forces acting vertically on the drive member are created which cause additional frictional losses. However these losses are significantly smaller, with widely different cartridge dispensing ratios, than the frictional losses which are avoided and which would otherwise be encountered by horizontal moments caused by the widely different reaction forces acting on the thrust ram. This is because the impact of forces can be shifted laterally, as shown, to the optimum value. The total advantages are that smaller tilting moments, and thus smaller frictional losses, are generated on all members of the device, efficiency is further optimized and smaller loads are applied to the parts.

In the Figures showing the following embodiments, unmodified parts are designated and referred to in the same way as in the preceding embodiments so that only new or modified parts receive new reference numbers.

Figure 7:
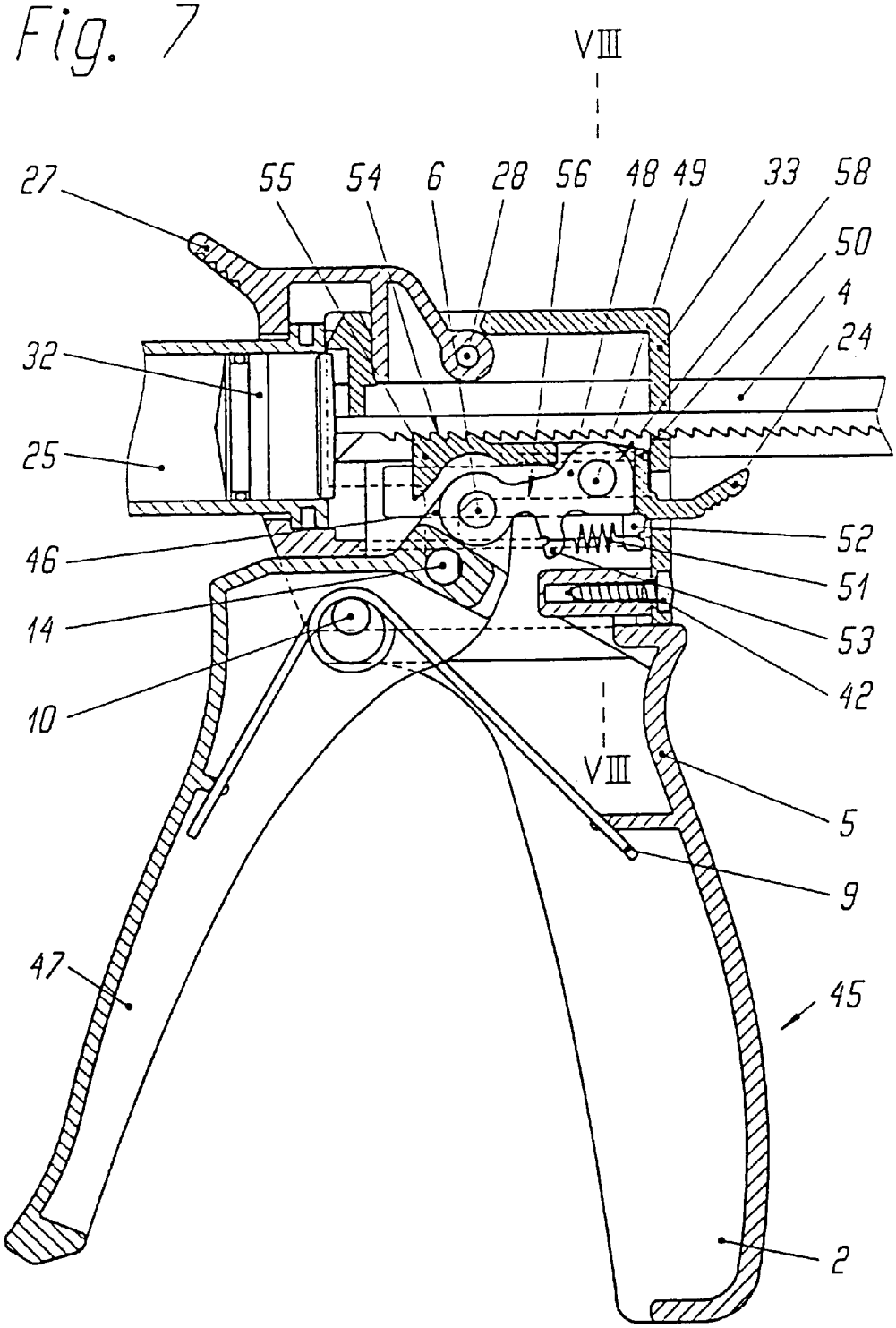
FIG. 7 shows a longitudinally sectioned view of a second embodiment of a dispensing device according to the invention.

The device 45 according to FIG. 7, which is especially suited for widely different dispensing ratios, has a similar construction as that of FIG. 1 and comprises the same handle 2 which is provided with a trigger lever 47 adapted in the upper portion 46. The trigger lever 47 acts through a drive member 50 on the double thrust ram 4 which, in turn, acts on the pressure pistons 32 of a double cartridge 25 for dispensing the said two components. This handle 2 is integral with housing 5 which comprises different guides, ribs etc. as well as a cover 33 which is fastened with screws 42.

The trigger lever 47 is connected by the upper pin 6 to one end of the compensating link 48 which is connected at its other end by a pin 49 to the drive member 50. This drive member is shown in detail in FIG. 8. The pin 49 constitutes the fulcrum of the drive member 50. The trigger lever 47 rotates about a pin 14 journalled in the housing and being disposed slightly below the upper pin 6. The compensating link 48 serves as an arc compensating member. The drive member 50 is charged by a tension spring 51 that is connected at one end to a nose 52 of the drive member 50 and, at the other end, to a nose 53 of the compensating link 48. The tension spring 51, in contrast to the embodiment according to FIG. 1, is located below the two pins 6 and 49, its function being the same as that of the compression spring 15 according to FIG. 1.

By positioning the drive member 50 below the toothing 18 of the double thrust ram 4, vertical jamming and tilting moments, respectively, must be accepted, but the full lateral offset of the force impact point is now possible; this offers a considerable advantage for minimizing the horizontal moments when widely different dispensing ratios are required.

Figure 8:
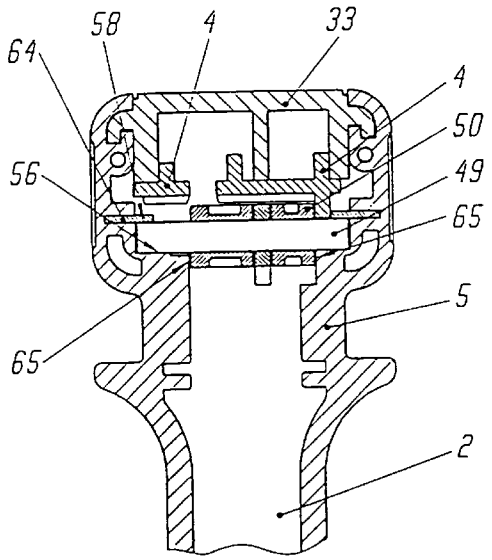
FIG. 8 shows a section of the dispensing device of FIG. 7 according to line VIII—VIII.

The trigger lever 47 is journalled and charged by the spring 9 in the same manner as that of FIG. 1. The drive member 50 comprises on its upper side, as seen in dispensing direction, a toothing 54 which is in meshing engagement with the toothing 18 of the double thrust ram 4. The guide of the compensating link 48 as shown in FIG. 8 is the same as shown in FIG. 2.

The drive member 50 which has a slide and latch like configuration comprises, in contrast to the two arms 19 in FIG. 1, only one traversing arm 55 having teeth 54 at its upper surface. The drive member is guided in the same way as in the embodiment according to FIG. 4. Differing from the embodiment according to FIG. 1, the remaining portion of the drive member 50 is guided via a pin 49 sliding upon a corresponding guiding surface 56 of the housing, see FIG. 7. The drive member 50 further comprises the lever 24 for disengaging the teeth 54 of the drive member 50 from the teeth 18 on the double thrust ram 4 and against the force of the tension spring 51, in order to allow a retraction of the double thrust ram 4.

Jamming of the drive member in vertical direction is prevented by the wide horizontal support and guidance of the pin 49 and the drive member 50 respectively, between the upper guiding surface 58 and the lower guiding surface 56.

Figure 11:
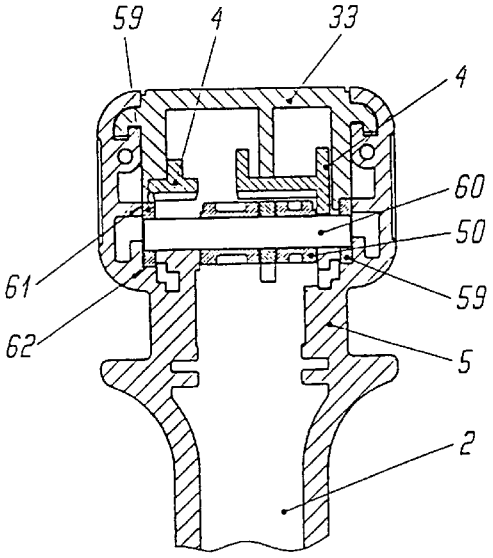
FIG. 11 shows a section of the dispensing device of FIG. 10 according to line XI—XI.
Figure 9:
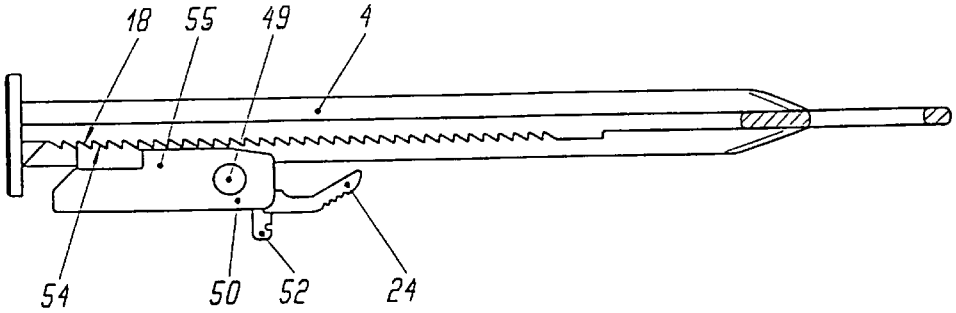
FIG. 9 shows a detail of the drive member of FIG. 7.
Figure 10:
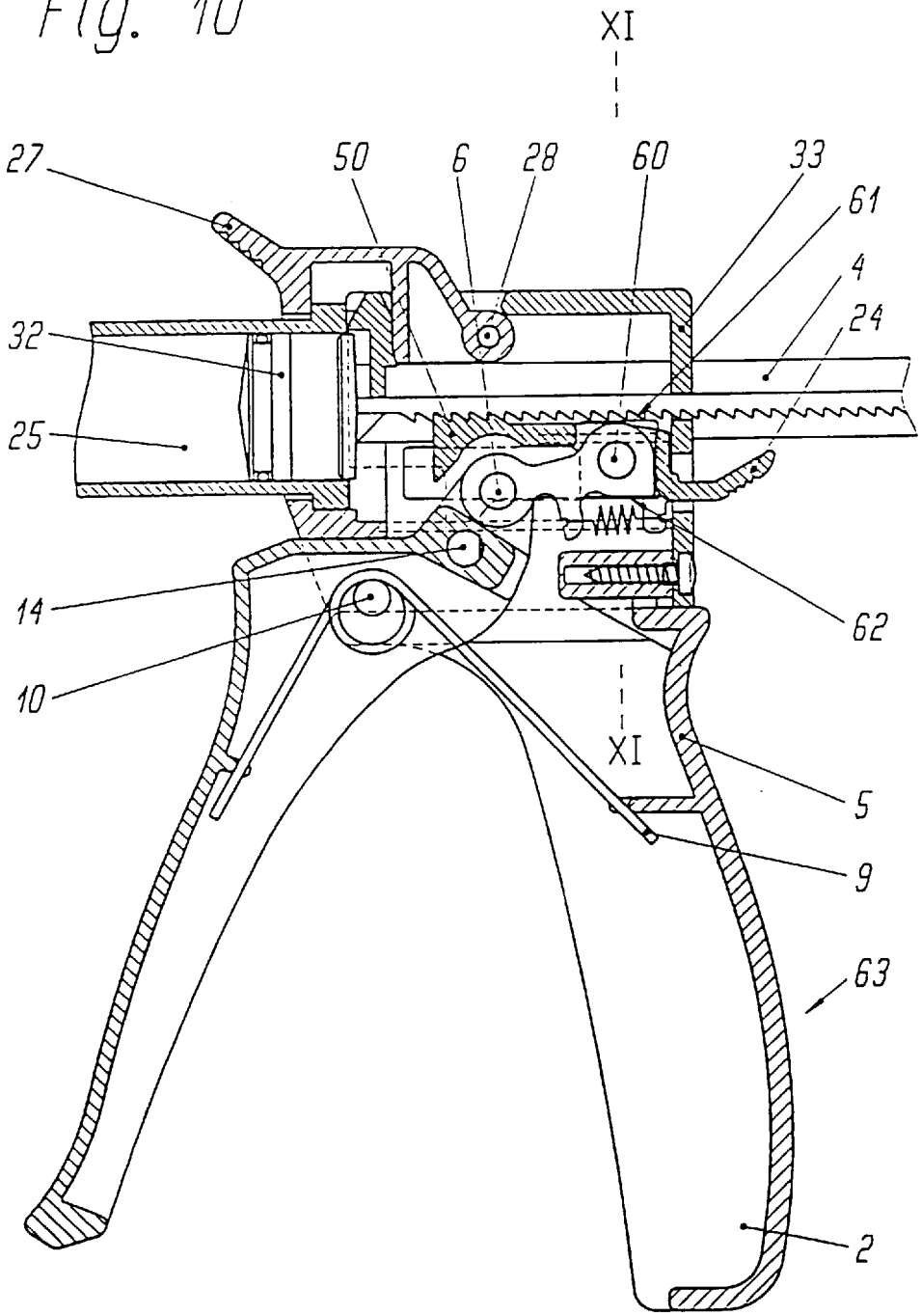
FIG. 10 shows a longitudinal section of a variant of the dispensing device of FIG. 7.

In the variant according to FIGS. 10 and 11, the guiding of the pin 60 is ensured by two sliding blocks 59. As it can be seen in FIGS. 10 and 11, the sliding blocks 59 are guided above and below in guides 61 and 62 between the housing and the cover. All other parts of the device 63 of the embodiment variant according to FIGS. 10 and 11 are identical with those of FIGS. 7 to 9.

Due to supporting and guiding of the drive member 50 by means of the pin 60 or of the sliding blocks 59 on the pin, the drive member cannot deviate upwards nor downwards. The drive member 50 journalled on the pin 60 is laterally guided by guides 65 and is free to move within the housing thus allowing it to make a linear advance and return motion during dispensing. However it is swivelled about the pins 49 and 60 during the return stroke and during retraction of the double thrust ram 4.

The working manner of the embodiments according to the FIGS. 7 to 11 is the same as that of the first embodiment. The difference is to be found in particular in that the pin 49 or 60 of the drive member 50 is located below the toothing plane of the thrust ram 4 and thus it is possible, as it can especially be seen in FIGS. 7 and 10, to dispose the toothing 54 of the drive member 50 at will on the width of the double thrust ram 4 and, further, to set the lateral impact point of the force exerted by trigger lever 47 and compensating link 48 in an optimum manner, thus ensuring that a sufficiently wide toothing can be maintained even with widely different dispensing ratios, for example 10:1. In addition, the lowest possible horizontal moments are obtained as the result of the different thrust ram reaction forces. It therefore follows that a maximum efficiency can be attained even with extreme dispensing ratios, whereas the increased vertical tilting moments caused by lowering of the force impact point have, by comparison, only a relatively small influence.

FIG. 1 shows a cartridge 25 which has been inserted and secured in an attachment means 26 of the dispensing device. The holding device comprises a retaining flap 27. Retaining flaps are thoroughly described in detail in EP-B-0,543,776 of the same Applicant. In the device according to FIG. 1, the retaining flap 27 is pivoted about an axle 28 as also indicated in FIG. 2, whereas the transmission of the retaining forces occurs directly onto the housing and not via the pivoting axle 28. The retaining flap 27 has, seen in its cross-section, a U-shaped part, whose first leg 38 retains the upper part of flange 29 of the cartridge and whose second leg 39 rests against a step 40 of the housing. The retaining flap designed in this manner has the effect that the entire cartridge flange 29 is now properly retained, avoiding flexing of the flange, and that the retaining forces are transmitted directly onto the housing with the pivot of the flap relieved from a load.

With different cartridge dispensing ratios or for the connection of a coded mixer, it may become necessary to insert the cartridges always in the same orientation into the dispensing device so that a coding between the cartridge and the dispensing device will offer advantages. Such a coding may for example be achieved by a projection or nose 30 FIG. 5A on the device and a corresponding notch 31 on the cartridge. This measure ensures that a cartridge cannot be inserted in an erroneous manner, or that an incorrectly inserted cartridge cannot be dispensed. The locations of the projection cam 30 and the notch 31 can also be interchanged.

Figure 5A:
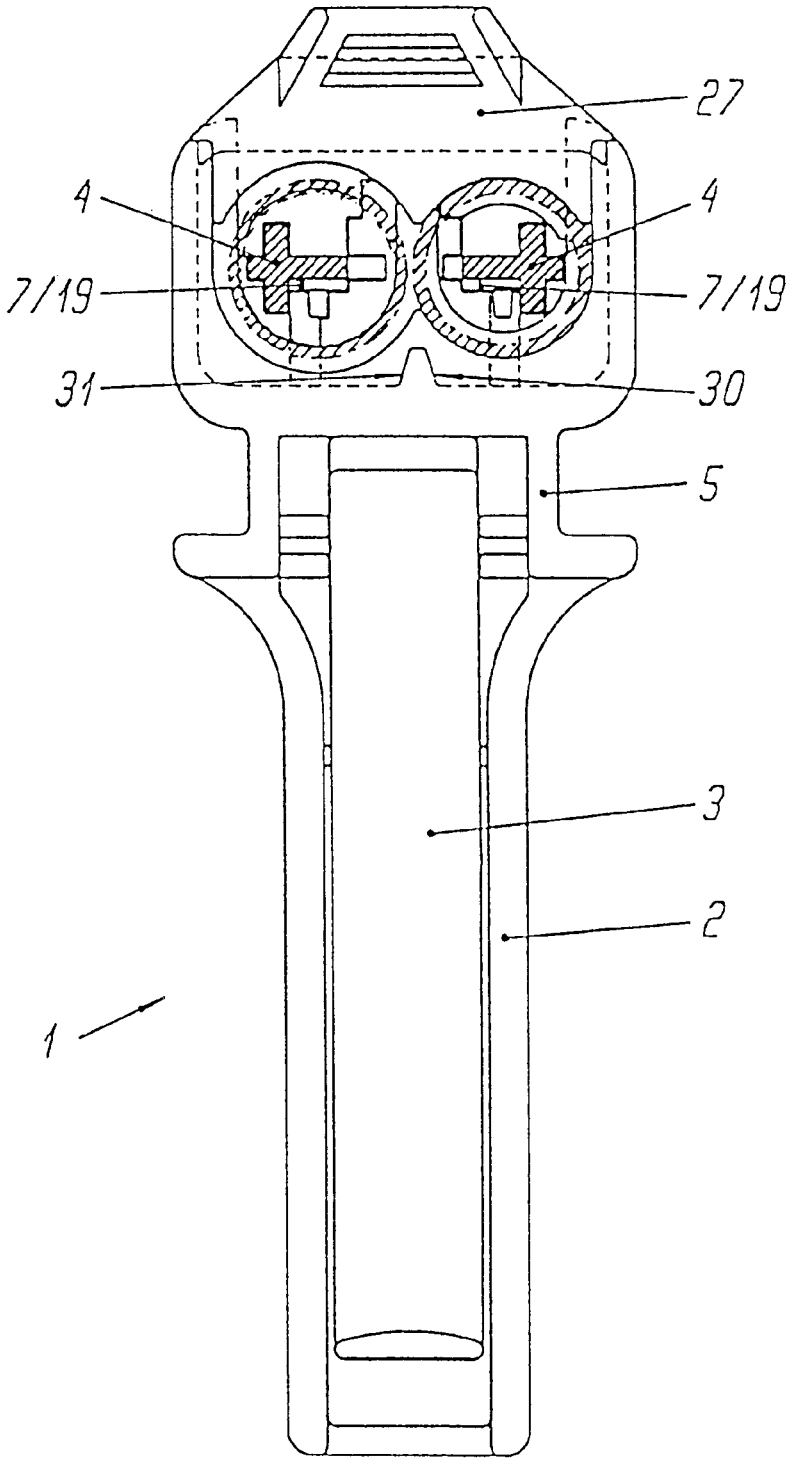
FIG. 5A shows the dispensing device of FIG. 1 in a front view.
Figure 5B:
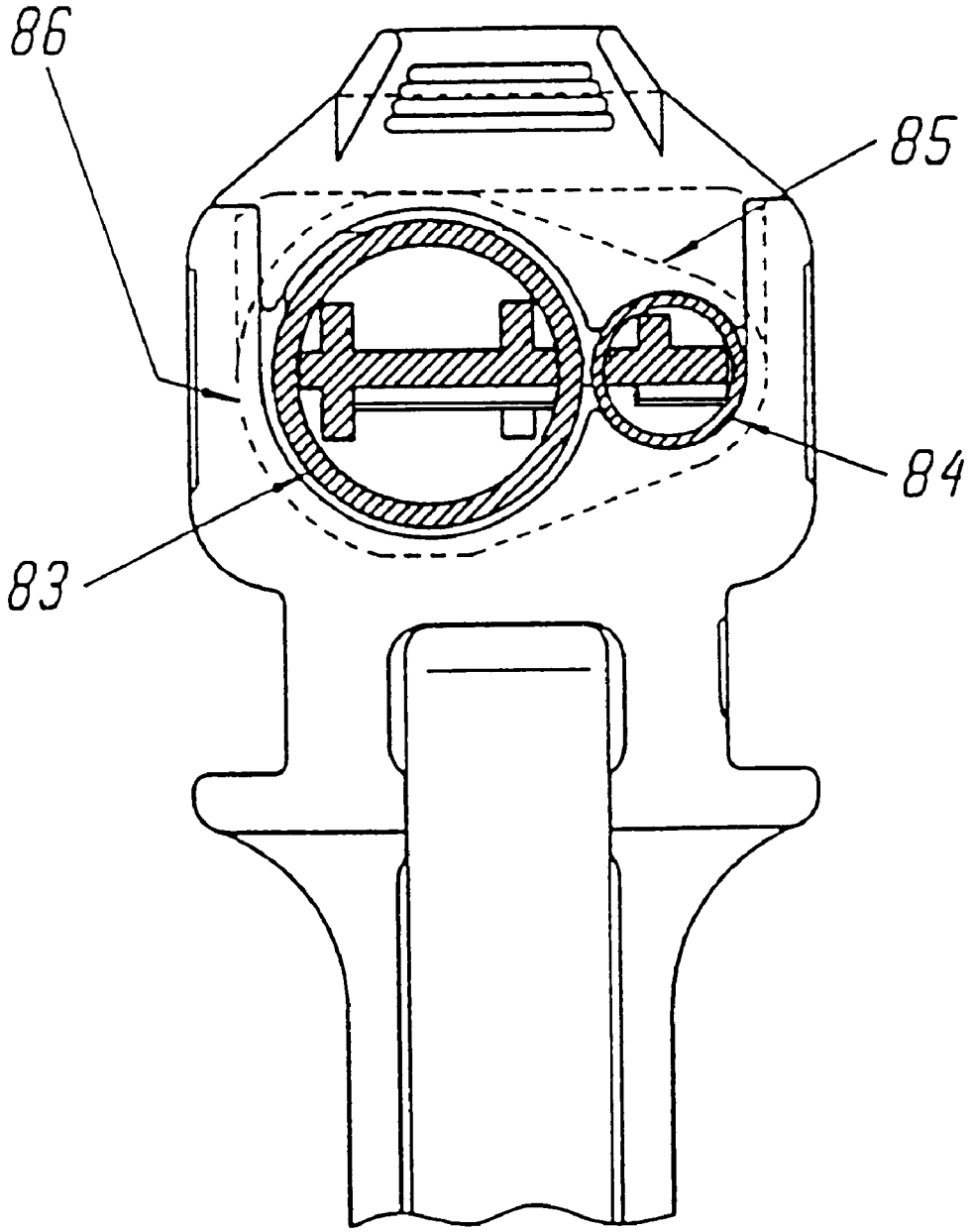
FIG. 5B shows a variant of the device according to FIG. 5A, FIGS. 6A and 6B show a variant of execution of the dispensing device of FIG. 1 in two positions.

A further coding can be achieved according to FIG. 5B, where the cylinders 83 and 84, having different diameters, lead to an asymmetric cartridge flange 85 whose outline serves as a coding means. The attachment means 86 of the device is correspondingly shaped so that the cartridge can only be introduced and locked in one orientation only. The other parts, members of the device and the flap, are similar to the example according to FIGS. 5A and 7, however without projection and notch.

Such coding means are not only applicable to the described device but can be applied generally to any insertion of cartridges into dispensing devices if a defined orientation is required.

What is claimed is:

1. A manually operated dispensing device for use with a double cartridge for dispensing two-component chemical systems, the device comprising:

a double thrust ram comprising a toothing; and a drive means acting on the double thrust ram and being actuated by a trigger lever, the drive means including:

a drive member which comprises a toothing acting on the toothing of the double thrust ram; and an arc compensating link arranged between the drive member and the trigger lever, the arc compensating link being connected for rotation at one of its ends through an upper pin to the trigger lever and at its other end through a fulcrum pin to the drive member wherein said fulcrum pin is the sole pivoting connection for the drive member, wherein the drive member is guided in such a manner that it is hindered from making any tilting motion or any motion transversely to the advance direction during its advance stroke but can effect a swiveling motion for allowing its disengagement from the double thrust ram for its return stroke or for regaining its grip with the double thrust ram following disengagement.

2. A manually operated dispensing device for use with a double cartridge for dispensing two-component chemical systems, the device comprising:

a double thrust ram having two plungers with a toothing; and a drive means acting on the double thrust ram and being actuated by a trigger lever, the drive means including:

a drive member which comprises a toothing acting on the toothing of the double thrust ram; and an arc compensating link arranged between the drive member and the trigger lever, the arc compensating link being connected for rotation at one of its ends through an upper pin to the trigger lever and at its other end through a fulcrum pin to the drive member, wherein the point of impact of forces on the upper pin of the trigger lever, as well as the fulcrum pin of the drive member, are located between the two plungers and at the level of the toothing of the double thrust ram.

3. A dispensing device according to claim 1 or 2, wherein the rear end portion of the arc compensating link is loaded by a compression or tension spring, respectively, acting via the fulcrum pin linked to the drive member on the toothed arms of the drive member in order to maintain, during the advance movement, its toothing in a meshing engagement with the toothing of the double thrust ram.

4. A dispensing device according to claim 1 or 2, wherein the drive member has a latch and slide like configuration with upper and lower surfaces rounded according to an arc of a circle, and the drive member further comprises a lever being integrally formed at an end of the drive member opposite to the toothing of the drive member for bring able to disengage the toothing of the drive member from the toothing of the double thrust ram.

5. A dispensing device according to claim 1 or 2, wherein the drive member has a latch and slide like configuration with upper and lower surfaces rounded according to an arc of a circle, and that the device further comprises an independent unlocking lever for disengaging the toothing of the drive member from the toothing of the double thrust ram.

6. A dispensing device according to claim 1, wherein the point of force impact on the upper pin of the trigger lever as well as the fulcrum pin of the drive member are located below the toothing of the double thrust ram.

7. A dispensing device according to claim 6, wherein the drive member has a latch and slide like configuration and is guided within the housing by the fulcrum pin connecting the drive member and the compensating link, said drive member further comprising at its end opposite to the toothing an integral lever for disengaging the toothing of the drive member from the toothing of the double thrust ram.

8. A dispensing device according to claim 7, wherein a sliding block is journalled on each end of the fulcrum pin and is guided at its upper and lower surfaces between guide surfaces of the cover or the housing, respectively.

9. A dispensing device according to claim 1 or 2, wherein it further comprises a friction brake acting on the double thrust ram.

10. A dispensing device according to claim 9, wherein the friction brake is an omega-shaped spring.

11. A dispensing device according to claim 1 or 2, comprising a double dispensing cartridge which includes a flange held in a attachment means and secured by a retaining flap, the retaining flap being connected to and pivoting about a housing and positively retaining the flange of the cartridge from behind.

12. A dispensing device and double dispensing cartridge according to claim 11, wherein the retaining flap, seen in its cross-section, comprises a U-shaped part whose first leg retains the cartridge flange from behind and whose second leg abuts against a step of the housing, for transmitting the retaining forces directly onto the housing.

13. A dispensing device and double dispensing cartridge according to claim 1 or 2, wherein the cartridge and the dispensing device are provided with coding means in such a manner that the cartridge can be inserted into said attachment means in one predetermined orientation only.

14. A dispensing device and double dispensing cartridge according to claim 13, wherein the coding means comprises a projection at the dispensing device and a notch at the cartridge, or vice versa.

15. A dispensing device and double dispensing cartridge according to claim 13, wherein the coding means comprise a contoured attachment means and an asymmetric cartridge flange whose shape essentially follows the outline of the different cartridge cylinders.

16. A manually operated dispensing device for use with a double cartridge for dispensing two-component chemical systems, the device comprising:

a double thrust ram comprising a toothing; and a drive means acting on the double thrust ram and being actuated by a trigger lever, the drive means including;

a drive member which comprises a toothing acting on the toothing of the double thrust ram; and an arc compensating link arranged between the drive member and the trigger lever, the arc compensating link being connected for rotation at one of its ends through an upper pin to the trigger lever and at its other end through a fulcrum pin to the drive member, the upper pin and the fulcrum pin being in a plane substantially parallel to the toothing of the double thrust ram, wherein the drive member is guided in such a manner that it is hindered from making any tilting motion or any motion transversely to the advance direction during its advance stroke but can effect a swiveling motion for allowing its disengagement from the double thrust ram for its return stroke or for regaining its grip with the double thrust ram following disengagement.

* * * * *